US008860624B2

(12) United States Patent
Yonezawa et al.

(10) Patent No.: US 8,860,624 B2
(45) Date of Patent: Oct. 14, 2014

(54) WIRELESS EXPLOSION-PROOF APPARATUS

(75) Inventors: Masaaki Yonezawa, Tokyo (JP); Satoshi Mochizuki, Tokyo (JP)

(73) Assignee: Yokogawa Electric Corporation, Tokyo (JP)

( * ) Notice: Subject to any disclaimer, the term of this patent is extended or adjusted under 35 U.S.C. 154(b) by 478 days.

(21) Appl. No.: 13/170,668

(22) Filed: Jun. 28, 2011

(65) Prior Publication Data

US 2011/0316757 A1 Dec. 29, 2011

(30) Foreign Application Priority Data

Jun. 29, 2010 (JP) ..... 2010-147449
Nov. 5, 2010 (JP) ..... 2010-248177
Apr. 15, 2011 (JP) ..... 2011-091022

(51) Int. Cl.
*H01Q 1/48* (2006.01)
*H01Q 1/00* (2006.01)
*H01Q 1/50* (2006.01)

(52) U.S. Cl.
CPC . *H01Q 1/002* (2013.01); *H01Q 1/50* (2013.01)
USPC ..... 343/846; 343/906; 343/702

(58) Field of Classification Search
USPC ..... 343/702, 906, 850, 846
See application file for complete search history.

(56) References Cited

U.S. PATENT DOCUMENTS

| | | | | |
|---|---|---|---|---|
| 6,980,174 | B2 * | 12/2005 | Flasza et al. | 343/850 |
| 2004/0066588 | A1 | 4/2004 | Flasza et al. | |
| 2006/0214857 | A1 * | 9/2006 | Ollikainen | 343/702 |
| 2008/0042907 | A1 * | 2/2008 | Webb et al. | 343/700 MS |
| 2008/0231527 | A1 * | 9/2008 | Lemke et al. | 343/725 |

FOREIGN PATENT DOCUMENTS

| | | | |
|---|---|---|---|
| CN | 1610182 | A | 4/2005 |
| EP | 1154516 | A1 | 11/2001 |
| JP | 62-66705 | A | 3/1987 |
| JP | 5-88144 | U | 11/1993 |
| JP | 6-57042 | A | 3/1994 |
| JP | 6-57042 | U | 8/1994 |
| JP | 9-182284 | A | 7/1997 |
| JP | 11-266529 | A | 9/1999 |
| JP | 2000-4533 | A | 1/2000 |
| JP | 2006-42558 | A | 2/2006 |
| JP | 2007-259662 | A | 10/2007 |

OTHER PUBLICATIONS

Japanese Office Action, dated Sep. 20, 2012, issued by the Japanese Patent Office in corresponding Japanese Application No. 2011-091022.

Extended European Search Report issued on Nov. 3, 2011 in the corresponding European Patent Application No. 11171630.4.

* cited by examiner

*Primary Examiner* — Dieu H Duong
(74) *Attorney, Agent, or Firm* — Sughrue Mion, PLLC

(57) ABSTRACT

A wireless explosion-proof apparatus includes an antenna, an explosion-proof chamber, a communication module disposed in the explosion-proof chamber, the communication module configured to transmit and receive a wireless signal through the antenna, a connector portion having a central conductor, to which the antenna is electrically connected, the central conductor having one end connected to the communication module through a connection line and the other end exposed to the outside of the explosion-proof chamber, and a short stub module disposed in the explosion-proof chamber and disposed on the connection line, the short stub module configured to secure electric conduction between the one end of the central conductor and a ground so as to keep potential of the central conductor at certain potential.

7 Claims, 14 Drawing Sheets

Conventional

WIRELESS EXPLOSION-PROOF APPARATUS

TECHNICAL FIELD

The present disclosure relates to a wireless explosion-proof apparatus in which a communication module for transmitting/receiving a wireless signal through an antenna is disposed. Particularly, the present disclosure relates to a wireless explosion-proof apparatus which satisfies explosion-proof specification (explosion-proof specification (IEC 60079-15) established by Type-n explosion-proof specification (IEC (International Electrotechnical Commission)) properly without using any pressure-tight chamber and which can attain high-performance wireless communication.

Here, examples of wireless explosion-proof apparatuses according to the invention include apparatuses (relay units for wireless communication, gateway units, etc.) which must correspond to explosion-proof standards, such as field devices each having a wireless communication function. The field devices include various field devices such as differential pressure gauges, flowmeters, thermometers, surveillance cameras, actuators, controllers, etc.

RELATED ART

Any related-art wireless explosion-proof apparatus is installed in a hazardous location such as a factory or a plant where flammable gas or the like is present. A power supply cable is connected to the wireless explosion-proof apparatus so as to supply electric power thereto from an external power source.

It is desired that the wireless explosion-proof apparatus is disposed in a totally enclosed chamber with a pressure-tight explosion-proof structure when the wireless explosion-proof apparatus is installed in a "hazardous location" where explosive atmosphere such as combustible gas or steam of inflammable substances may be generated (JP-UM-A-6-57042).

The totally enclosed chamber with the pressure-tight explosion-proof structure is designed to bear explosion pressure and prevent flame caused by explosion from touching off the combustible gas, the steam of inflammable substances, etc. outside the chamber when explosion occurs in the inside of the chamber.

In addition, the related-art wireless explosion-proof apparatus is designed to allow the antenna to serve as a proper antenna for a wireless apparatus, and prevent energy caused by a power supply system of the wireless apparatus from flowing out to the explosive atmosphere outside the chamber through the antenna so as to prevent explosion from occurring even if the power supply system has a breakdown.

FIG. 14 is a sectional view showing a configuration example of a related-art wireless explosion-proof apparatus.

In FIG. 14, in the related-art wireless explosion-proof apparatus, an explosion-proof pressure-tight chamber 1 is disposed in a "hazardous location". An antenna 4 disposed in an antenna cover member 2 is formed to penetrate a part of an outer wall of the explosion-proof pressure-tight chamber 1 and protrude therefrom.

A communication module 3 is disposed in the explosion-proof pressure-tight chamber 1, and the antenna 4 connected to the communication module 3 is disposed in the antenna cover member 2. The antenna cover member 2 is formed out of a radio wave-transmissible member, and the communication module 3 makes communication with a field device (not shown) through the antenna 4.

The antenna cover member 2 is disposed in a protective cover member 5 such as a glass cover serving as an explosion-proof pressure-tight chamber. The protective cover member 5 is attached to the outer wall of the explosion-proof pressure-tight chamber 1 so as to cover the antenna cover member 2 and the antenna 4. The protective cover member 5 is made from, a raw material (a material such as glass or resin) through which at least high-frequency signals (electromagnetic waves) can be transmitted.

The communication module 3 is connected to a control portion through a cable outgoing portion (not shown) by means of a communication cable (not shown) so as to transmit and receive electric signals to/from the control portion. The control portion is disposed in a "safe location" while the cable outgoing portion penetrates a part of the outer wall of the explosion-proof pressure-tight chamber 1. In addition, the communication module 3 is connected to a power supply portion through a cable outgoing portion (not shown) by means of a power supply cable (not shown) so as to be supplied with electric power from the power supply portion. The power supply portion is disposed in a safe location while the cable outgoing portion penetrates a part of the outer wall of the explosion-proof pressure-tight chamber 1.

For example, the following Patent Document 1 has disclosed a configuration of a wireless explosion-proof apparatus which includes an antenna and a communication module in an explosion-proof pressure-tight chamber and which is connected to an external power supply portion through a power supply cable so as to be supplied with electric power and also connected to an external control portion through a communication cable so as to make communication with the external control portion.

PATENT DOCUMENT

[Patent Document 1] JP-A-9-182284

However, the related-art wireless explosion-proof apparatus is heavy in product weight due to a heavy explosion-proof pressure-tight chamber and a heavy protective cover member. For example, the location where the apparatus is desired to be installed may have to be reinforced if the location is high. Thus, there is a problem that the installation location may be limited.

In addition, in the related-art wireless explosion-proof apparatus, an antenna and a main body are formed integrally so that they cannot be separated from each other. Therefore, there is a problem that the location where the antenna is desired to be installed may be limited to affect the wireless communication performance.

In addition, in the related-art wireless explosion-proof apparatus, a material such as glass or resin is used as the material of the chamber. The material is easily affected and degraded by temperature change, ultraviolet rays, etc. as compared with metal. Thus, there is a problem that there are limitations in product specifications such as a temperature range, installation conditions, etc.

SUMMARY

Exemplary embodiments of the present invention provide a wireless explosion-proof apparatus which satisfies explosion-proof specification (Type-n explosion-proof specification) properly without using any pressure-tight chamber and which can attain high-performance wireless communication.

In the first configuration, a wireless explosion-proof apparatus comprises:

an antenna;

an explosion-proof chamber;

a communication module disposed in the explosion-proof chamber, the communication module configured to transmit and receive a wireless signal through the antenna;

a connector portion having a central conductor, to which the antenna is electrically connected, the central conductor having one end connected to the communication module through a connection line and the other end exposed to the outside of the explosion-proof chamber; and a short stub module disposed in the explosion-proof chamber and disposed on the connection line, the short stub module configured to secure electric conduction between the one end of the central conductor and a ground so as to keep potential of the central conductor at certain potential.

In the second configuration, a wireless explosion-proof apparatus comprises:

an antenna;

an explosion-proof chamber;

a communication module disposed in the explosion-proof chamber, the communication module configured to transmit and receive a wireless signal through the antenna;

a connector portion having a central conductor, to which the antenna is electrically connected, the central conductor having one end connected to the communication module through a connection line and the other end exposed to the outside of the explosion-proof chamber; and a parallel resonant module disposed in the explosion-proof chamber and disposed on the connection line, the parallel resonant module configured to resonate based on a frequency of the wireless signal, the parallel resonant module configured to secure electric conduction between the one end of the central conductor and a ground so as to keep potential of the central conductor at certain potential.

In the third configuration, the antenna may be connected to the other end of the central conductor of the connector portion and disposed outside the explosion-proof chamber.

In the fourth configuration, the wireless explosion-proof apparatus may further comprise:

a cable module configured to transmit the signal from the antenna, wherein the antenna is connected to the other end of the central conductor of the connector portion through the cable module.

In the fifth configuration, the wireless explosion-proof apparatus may further comprise:

a blocking capacitor module disposed in the explosion-proof chamber and disposed on the connection line, the blocking capacitor module configured to block a DC current from the communication module.

In the sixth configuration, the short stub module may be a filter configured to eliminate a certain signal component from the signal transmitted and received by the communication module.

In the seventh configuration, the short stub module may include a distributed constant circuit.

In the eighth configuration, the short stub module may be formed to correspond to a plurality of bands, the short stub having a first connection line pattern in which a high-frequency signal is inputted from one end and outputted from the other end in a horizontal direction, and a second connection line pattern one end of which is connected to a central portion of a lower side of the first connection line pattern at right angles and the other end of which is DC-connected to the ground through at least one of crank-like patterns connected in series.

In the ninth configuration, the short stub module may further have a third connection line pattern which is a straight-line pattern serving as an open stub, the third connection line having one end disposed oppositely to a central portion of an upper side of the first connection line pattern at right angles and with interposition of a variable capacitance element whose capacitance value can be varied in accordance with a voltage applied thereto.

In the tenth configuration, the short stub module may include a lumped constant circuit.

According to the first configuration, the short stub module is disposed in the explosion-proof chamber and on the connection line, through which one end of the central conductor of the connector portion for the antenna is connected to the communication module, and the short stub module secures electric conduction between the one end of the central conductor and the ground so as to keep potential of the central conductor at certain potential, while the other end of the central conductor of the connector portion for the antenna is exposed to the outside of the explosion-proof chamber. Thus, explosion-proof specification (Type-n explosion-proof specification) can be satisfied properly without using any pressure-tight chamber, and high-performance wireless communication can be performed.

According to the second configuration, the parallel resonant module resonating based on a frequency of the wireless signal is disposed in the explosion-proof chamber and on the connection line, through which one end of the central conductor of the connector portion for the antenna is connected to the communication module, and the parallel resonant module secures electric conduction between the one end of the central conductor and the ground so as to keep potential of the central conductor at certain potential, while the other end of the central conductor of the connector portion for the antenna is exposed to the outside of the explosion-proof chamber. Thus, explosion-proof specification (Type-n explosion-proof specification) can be satisfied properly without using any pressure-tight chamber, and high-performance wireless communication can be performed. When the parallel resonant module is provided, the same effect as that in the case where a short stub module is used can be obtained without any influence on the dimensions of the wireless explosion-proof apparatus even if the operating wireless frequency is reduced.

According to the third or fourth configuration, the central conductor of the connector portion for the antenna is exposed to the outside of the explosion-proof chamber so that the following effects can be obtained.

A: The configuration is effective in view of availability of a plurality of kinds of antennas. Specifically, an antenna can be selected and combined with the main body according to use purpose to perform high-performance wireless communication because the antenna does not have to be integrated with the explosion-proof chamber (main body).

B: The configuration is effective in view of flexibility as to the location where the antenna can be installed. Specifically, the antenna can be connected to the connector portion for the antenna through a high-frequency cable because the antenna does not have to be integrated with the explosion-proof chamber (main body). Accordingly, the antenna can be installed in a different location from the location where the main body is installed. Thus, high-performance wireless communication can be performed.

According to the fifth configuration, the blocking capacitor module for blocking a DC current from the communication module is provided in the explosion-proof chamber and on the connection line through which one end of the central conductor of the connector portion is connected to the communication module. Thus, an intrinsically safe explosion-proof structure is formed properly without using any pressure-tight chamber, so that high-performance wireless communication can be performed.

In addition, when a plurality of blocking capacitor modules are provided, surviving ones of the blocking capacitor modules can work even if any one of the blocking capacitor modules is damaged. Thus, intrinsically safe explosion-proof specifications can be satisfied without occurrence of DC potential in the central conductor.

According to the sixth configuration, the short stub module is disposed in the explosion-proof chamber and on the connection line, through which one end of the central conductor of the connector portion for the antenna is connected to the communication module, and the short stub module secures electric conduction between the one end of the central conductor and the ground so as to keep potential of the central conductor at certain potential, while the other end of the central conductor of the connector portion for the antenna is exposed to the outside of the explosion-proof chamber. Thus, explosion-proof specification (Type-n explosion-proof specification) can be satisfied properly without using any pressure-tight chamber, and high-performance wireless communication can be performed. Further, when a short stub module for obtaining the effect of a notch filter is used, wireless communication with certain frequency characteristics can be attained.

According to the seventh configuration, the short stub module is disposed in the explosion-proof chamber and on the connection line, through which one end of the central conductor of the connector portion for the antenna is connected to the communication module, and the short stub module secures electric conduction between the one end of the central conductor and the ground so as to keep potential of the central conductor at certain potential, while the other end of the central conductor of the connector portion for the antenna is exposed to the outside of the explosion-proof chamber. Thus, explosion-proof specification (Type-n explosion-proof specification) can be satisfied properly without using any pressure-tight chamber, and high-performance wireless communication can be performed. Further, when a short stub module using interlayer coupling is used, high-performance wireless communication with certain frequency characteristics can be attained.

According to the eighth configuration, the shapes of the first connection line pattern and the second connection line pattern which constitute the short stub module are arranged, so that the short stub module corresponding to a plurality of bands can obtain.

According to the ninth configuration, the shapes of the first connection line pattern, the second connection line pattern and the third connection line pattern which constitute the short stub module are arranged, and the voltage applied to the variable capacitance element is adjusted, so that the short stub module can obtain desired frequency characteristics corresponding to a plurality of bands.

According to the tenth configuration, the short stub module is disposed in the explosion-proof chamber and on the connection line, through which one end of the central conductor of the connector portion for the antenna is connected to the communication module, and the short stub module secures electric conduction between the one end of the central conductor and the ground so as to keep potential of the central conductor at certain potential, while the other end of the central conductor of the connector portion for the antenna is exposed to the outside of the explosion-proof chamber. Thus, explosion-proof specification (Type-n explosion-proof specification) can be satisfied properly without using any pressure-tight chamber, and high-performance wireless communication can be performed. Further, when a short stub module using a lumped constant circuit is used, wireless communication with certain frequency characteristics can be performed, and the space can be saved.

DETAILED DESCRIPTION

First Embodiment

Figure 1:
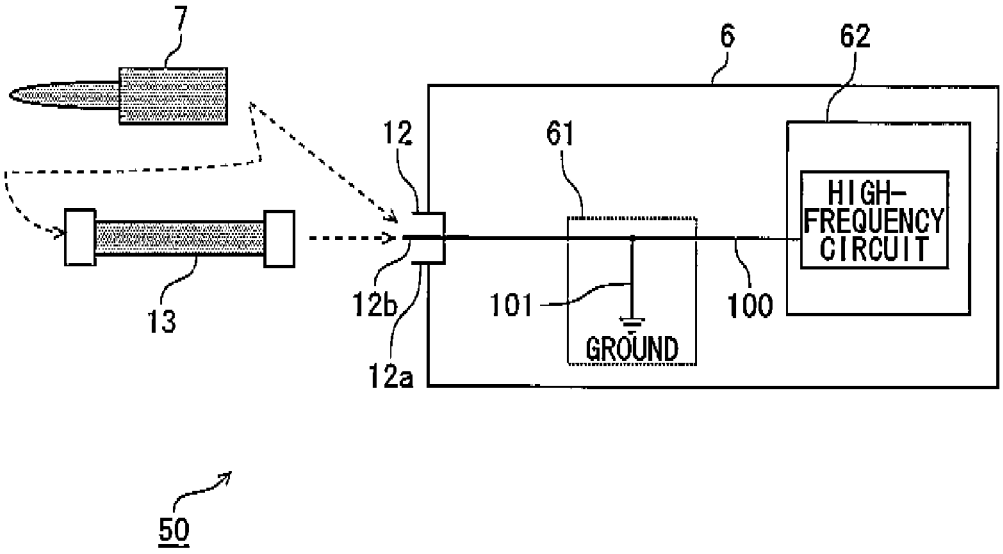
FIG. 1 is an explanatory configuration view showing an embodiment of a wireless explosion-proof apparatus according to the invention.
Figure 2:
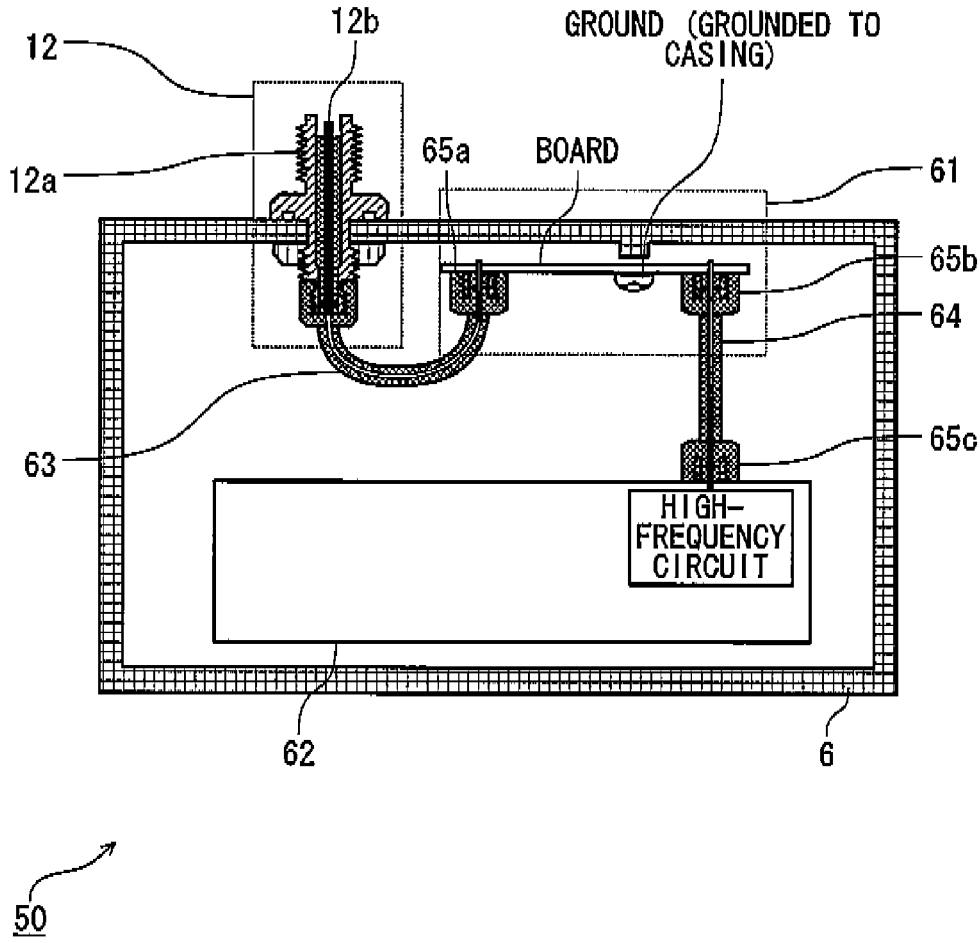
FIG. 2 is a detailed explanatory configuration view of FIG. 1.

The invention will be described below in detail with reference to the drawings. FIG. 1 is an explanatory configuration view showing an embodiment of a wireless explosion-proof apparatus according to the invention. FIG. 2 is a detailed explanatory configuration view of FIG. 1. Description on components in FIGS. 1 and 2 in common with those in FIG. 14 will be omitted appropriately.

Figure 14:
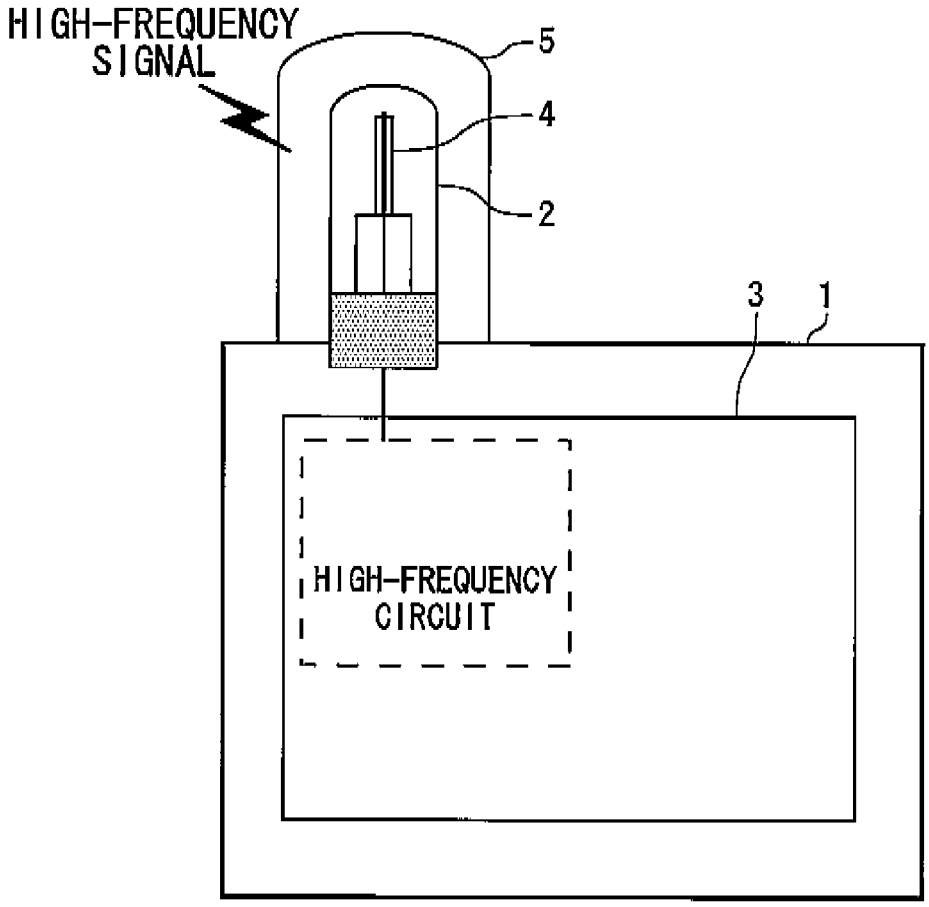
FIG. 14 is a sectional view showing a configuration example of a related-art wireless explosion-proof apparatus.

The configuration of FIGS. 1 and 2 is different from that of FIG. 14 in the following points. That is, the antenna cover member and the protective cover member are not provided. A short stub module is disposed in an explosion-proof chamber and on a connection line through which one end of a central conductor of a connector portion for an antenna is connected to a communication module, so that the short stub module can secure electric conduction between the one end of the central conductor and the ground so as to keep potential of the central conductor at certain potential. The other end of the central conductor of the connector portion for the antenna is exposed to the outside of the explosion-proof chamber.

(Description of Configuration)

In FIG. 1, a wireless explosion-proof apparatus 50 has a short stub module 61 and a communication module 62 in an explosion-proof chamber 6. The explosion-proof chamber 6 is disposed in a "hazardous location". The communication module 62 has a high-frequency signal processing function (high-frequency circuit). For example, the communication module 62 is a transmitter/receiver for transmitting/receiving a high-frequency signal (wireless signal).

The explosion-proof chamber 6 is made from a metal material. The explosion-proof chamber 6 may not have a special pressure-tight function.

In the wireless explosion-proof apparatus 50, an antenna connector 12 is formed so as to penetrate a part of an outer wall of the explosion-proof chamber 6 and protrude therefrom. A central conductor 12*b* of the antenna connector 12 as an example of a connector portion for an antenna 7 is extended from a sectionally central portion of a shell 12*a*. The other end of the central conductor 12*b* is exposed to the outside of the explosion-proof chamber 6.

The antenna 7 is plugged into the antenna connector 12 so as to be electrically connected to the central conductor 12*b*. The antenna 7 may be connected to the antenna connector 12 through a high-frequency cable 13 as an example of a cable module for transmitting a signal from the antenna 7. In addition, the antenna may be an antenna having various functions such as a compact function, a high gain function, a directive function, etc. in accordance with use purposes in wireless communication.

One end of the central conductor 12*b* of the antenna connector 12 is electrically connected to the communication module 62 through a connection line 100.

The short stub module 61 is disposed in the explosion-proof chamber 6 and on the connection line 100 through which one end of the central conductor 12*b* of the antenna connector 12 is electrically connected to the communication module 62, so that the short stub module 61 can branch a current from the central conductor 12*b* and secure electric conduction between the one end of the central conductor 12*b* and the ground so as to keep potential of the central conductor 12*b* at certain potential.

The short stub module 61 has a stub 101 whose electric length corresponds to a quarter of the wavelength of a high frequency used by the wireless explosion-proof apparatus 50. The connection line 100 through which the one end of the central conductor 12*b* is electrically connected to the communication module 62 is short-circuited in terms of DC (direct current) through the stub 101. The electric length of the short stub module 61 is not limited to the length corresponding to a quarter of the wavelength of the high frequency, but may be a length satisfying $(2n+1)\times\lambda/4$ (n an integer) when the wavelength of the operating frequency is $\lambda$. The impedance of the short stub frequency 61 is infinite in the operating frequency.

The communication module 62 transmits/receives a high-frequency signal to/from a field device (not shown) through the antenna 7.

For example, the communication module 62 outputs a high-frequency signal generated by the high-frequency circuit. The high-frequency signal is inputted into the antenna connector 12 through the connection line 100 and the short stub module 61. The high-frequency signal is released to a space from the antenna 7 and transmitted to the field device.

On the other hand, upon reception of a high-frequency signal from the antenna 7 through the antenna connector 12, the communication module 62 transmits the high-frequency signal to a control portion through a cable outgoing portion (not shown) by means of a communication cable (not shown). The cable outgoing portion penetrates a part of the outer wall of the explosion-proof chamber 6. The control portion is disposed in a "safe location". The communication module 62 is connected to a power supply portion through a cable outgoing portion (not shown) by means of a power supply cable (not shown) so as to be supplied with electric power. The cable outgoing portion penetrates a part of the outer wall of the explosion-proof chamber 6. The power supply portion is disposed in the "safe location".

The configuration of these components will be described more in detail with reference to FIG. 2.

Specifically, as shown in FIG. 2, the antenna connector 12 is, for example, an N-type connector. A part of the shell 12*a* having a threaded outer circumferential portion is exposed to the outside of the explosion-proof chamber 6, while the other part of the shell 12*a* is disposed inside the explosion-proof chamber 6. In addition, the central conductor 12*b* of the antenna connector 12 is extended in the longitudinal direction of the connector in the sectionally central portion of the shell 12*a*, and the other end of the central conductor 12*b* is exposed to the outside of the explosion-proof chamber 6.

The other end of the central conductor 12*b* of the antenna connector 12 is plugged into a long hole formed in one end of the antenna 7 and electrically connected thereto. Here, a threaded inner circumferential portion is formed in the one end of the antenna 7, and the one end of the antenna 7 is screwed into the shell 12*a* and fixed thereto.

Here, in order to arrange the short stub module 61 as shown in FIG. 2, the wireless explosion-proof apparatus 50 has a short stub block in the explosion-proof chamber 6. In the short stub block, wiring is formed using a (printed) board to secure electric connection between the one end of the central conductor 12*b* and the communication module 62 and electric conduction between the one end of the central conductor 12*b* and the ground to thereby keep the potential of the central conductor 12*b* at certain potential.

Specifically, the one end of the central conductor 12*b* of the antenna connector 12 is electrically connected to one end of a conductor of a first coaxial cable 63 (internal wiring).

The other end of the conductor of the first coaxial cable 63 is electrically connected to one end of the connection line 100 (one end of the short stub module 61) through a first internal connection connector 65*a*. The connection line 100 is wired on the board of the short stub block so as to be electrically connected to the communication module 62.

The communication module 62 is connected to the other end of the connection line 100 (the other end of the short stub module 61) through a third internal connection connector 65*c*, a second coaxial cable 64 (internal wiring) and a second internal connection connector 65*b*.

That is, the connection line 100 is wired on the board so as to electrically connect the one end of the central conductor 12*b* to the communication module 62.

The one end of the central conductor 12*b* of the antenna connector 12 is electrically connected to the ground (grounded to the casing) through the connection line (stub) 101 which is wired so that the current flowing from the central conductor 12*b* can be branched from the connection line 100 which is electrically connected to the communication module 62.

In this manner, the wireless explosion-proof apparatus has a short stub block as shown in FIG. 2. The short stub module 61 branches the current flowing from the central conductor 12*b* from the connection line 100 which electrically connect the one end of the central conductor 12*b* of the antenna connector 12 to the communication module 62, and secures electric conduction between the one end of the central conductor 12*h* and the ground. Thus, the potential of the central conductor 12*b* is kept at certain potential.

(Operation and Effects)

With this configuration, the wireless explosion-proof apparatus according to the invention performs the following operation to fulfill the following effects.

For example, the communication module 62 outputs a high-frequency signal generated by the high-frequency circuit. The high-frequency signal is inputted to the antenna connector 12 through the short stub module 61.

When the antenna 7 is connected directly to the antenna connector 12, the high-frequency signal is supplied to the antenna 7 through the antenna connector 12, released to the space and transmitted to an external field device or the like.

When the antenna 7 is connected to the antenna connector 12 through the high-frequency cable 13, the high-frequency signal is supplied from the antenna connector 12 to the antenna 7 through the high-frequency cable 13, released to the space and transmitted to the external field device or the like.

When the high-frequency signal is inputted/outputted between the communication module 62 and the antenna 7, the signal path is connected to the ground through the short stub module 61. However, an extremely small part of the high-frequency signal is branched into the ground because the short stub module 61 has very high impedance in the frequency of the high-frequency signal.

In addition, when the central conductor of the antenna connector 12 is observed from the outside of the wireless explosion-proof apparatus, the conductor is connected to the ground through the stub. Thus, the potential of the conductor is normally zero.

Here, when the wireless explosion-proof apparatus according to the invention is evaluated as an explosion-proof apparatus, the central conductor 12*b* of the antenna connector 12 is regarded as a bare live part because the central conductor 12*b* of the antenna connector 12 is exposed to the outside. In the Type-n explosion-proof specification, some measure has to be taken to set down the potential of the bare live part even when a wiring portion is out of order.

On the other hand, in the wireless explosion-proof apparatus according to the invention, the central conductor 12*b* of the antenna connector 12 is always electrically connected to the ground through the short stub module 61 as described above. Accordingly, the potential of the central conductor 12*b* can be kept at the ground potential even when a wiring portion (such as wiring of the communication module 62, connection with the antenna 7, internal wiring in the explosion-proof chamber 6, etc.) is out of order. Thus, the explosion-proof specification can be satisfied even if the central conductor 12*b* of the antenna connector 12 is exposed to the outside.

In addition, the wireless explosion-proof apparatus according to the invention satisfies the explosion-proof specification without using any pressure-tight chamber (pressure chamber). The wireless explosion-proof apparatus according to the invention is effective in reducing the product weight. In addition, a glass or resin material does not have to be used as the material of a protective chamber of the antenna. Thus, it is possible to reduce restrictions in product specifications, including a temperature range, installation conditions, etc.

In addition, the wireless explosion-proof apparatus according to the invention can obtain the following effects because the central conductor 12*b* of the antenna connector 12 is exposed to the outside of the explosion-proof chamber 6.

A: The configuration is effective in view of availability of a plurality of kinds of antennas. Specifically, an antenna can be selected and combined with the main body according to use purpose to perform high-performance wireless communication because the antenna does not have to be integrated with the explosion-proof chamber (main body).

B: The configuration is effective in view of flexibility as to the location where the antenna can be installed. Specifically, the antenna can be connected to the connector portion for the antenna through a high-frequency cable because the antenna does not have to be integrated with the explosion-proof chamber (main body). Accordingly, the antenna can be installed in a different location from the location where the main body is installed. Thus, high-performance wireless communication can be performed.

Accordingly, in the wireless explosion-proof apparatus according to the invention, the short stub module is disposed in the explosion-proof chamber and on the connection line, through which one end of the central conductor of the connector portion for the antenna is connected to the communication module, and the short stub module secures electric conduction between the one end of the central conductor and the ground so as to keep potential of the central conductor at certain potential, while the other end of the central conductor of the connector portion for the antenna is exposed to the outside of the explosion-proof chamber. Thus, explosion-proof specification (Type-n explosion-proof specification) can be satisfied properly without using any pressure-tight chamber, and high-performance wireless communication can be performed.

Second Embodiment

In the wireless explosion-proof apparatus according to the invention, the communication module may be connected to the central conductor of the antenna connector through blocking capacitors, in addition to the configuration of the first embodiment.

Figure 3:
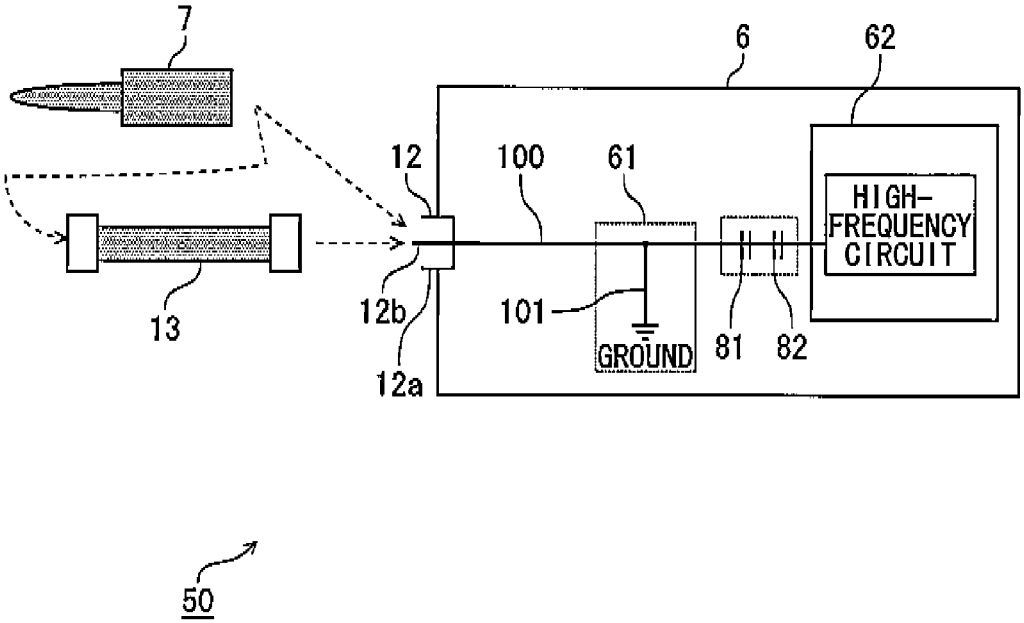
FIG. 3 is an explanatory configuration view showing another embodiment of a wireless explosion-proof apparatus according to the invention.

FIG. 3 is an explanatory configuration view showing another embodiment of a wireless explosion-proof apparatus according to the invention. Description on components in FIG. 3 in common with those in FIG. 1 will be omitted appropriately.

(Description of Configuration)

In FIG. 3, the central conductor 12*b* of the antenna connector 12 is extended from the sectionally central portion of the shell 12*a* and the other end of the central conductor 12*b* is exposed to the outside of the explosion-proof chamber 6.

The one end of the central conductor 12*b* of the antenna connector 12 is electrically connected to the communication module 62 through the connection line 100, a first blocking capacitor module 81 and a second blocking capacitor module 82.

The first blocking capacitor module 81 and the second blocking capacitor module 82 block a DC current from the communication module 62.

The short stub module 61 is disposed in the explosion-proof chamber 6 and on the connection line 100 through which one end of the central conductor 12*b* of the antenna connector 12 is electrically connected to the first blocking capacitor module 81, so that the short stub module 61 is wired to branch a current flowing from the central conductor 12*b* and secures electric conduction between the central conductor 12*b* and the ground. Thus, the potential of the central conductor 12*b* can be kept at certain potential.

The communication module 62 communicates with a field device (not shown) through the antenna 7.

For example, the communication module 62 has a high-frequency circuit for generating a high-frequency signal, and outputs the generated high-frequency signal. The high-frequency signal is inputted into the antenna connector 12 through the first blocking capacitor module 81, the second blocking capacitor module 82 and the short stub module 61.

(Operation and Effects)

With this configuration, the wireless explosion-proof apparatus according to the invention performs the following operation to fulfill the following effects.

Here, when the wireless explosion-proof apparatus according to the invention is evaluated as an explosion-proof apparatus, the central conductor 12*b* of the antenna connector 12 is regarded as a bare live part because the central conductor 12*b* of the antenna connector 12 is exposed to the outside. In the intrinsically safe explosion-proof specifications, some measure has to be taken to set down the potential of the bare live part even when a wiring portion is out of order. Further some measure has to be taken to prevent DC potential from being generated in the bare live part even if the communication module is out of order.

On the other hand, in the wireless explosion-proof apparatus according to the invention, the central conductor 12*b* of the antenna connector 12 is always electrically connected to the ground through the short stub module 61 as described above. Accordingly, the potential of the central conductor 12*b* can be kept at the ground potential even when a circuit portion (such as wiring of the communication module 62, connection with the antenna 7, internal wiring in the explosion-proof chamber 6, etc.) is out of order.

In addition, since the first blocking capacitor module 81 and the second blocking capacitor module 82 are disposed between the communication module 62 and the central conductor 12*b* of the antenna connector 12, a DC current from the communication module 62 can be blocked to prevent DC potential from being generated in the central conductor even if the communication module is out of order.

Thus, the intrinsically safe explosion-proof specifications can be satisfied even if the central conductor 12*h* of the antenna connector 12 is exposed to the outside of the explosion-proof chamber 6.

Accordingly, in the wireless explosion-proof apparatus of the invention, the blocking capacitor module for blocking a DC current from the communication module is provided in the explosion-proof chamber and on the connection line through which one end of the central conductor of the connector portion is connected to the communication module. Thus, an intrinsically safe explosion-proof structure is formed properly without using any pressure-tight chamber, so that high-performance wireless communication can be performed.

In addition, when a plurality of blocking capacitor modules are provided, surviving ones of the blocking capacitor modules can work even if any one of the blocking capacitor modules is damaged. Thus, intrinsically safe explosion-proof specifications can be satisfied without occurrence of DC potential in the central conductor.

Third Embodiment

The dimensions of the stub in the short stub module described in the first embodiment or the second embodiment increase in inverse proportion to the operating frequency. For this reason, it may be difficult to mount the short stub module due to the limitation of the apparatus dimensions when the operating frequency for wireless communication is low. Thus, it may be difficult to carry out the invention.

In the wireless explosion-proof apparatus according to the invention, however, the short stub module in the configuration of the first embodiment may be replaced by a parallel resonant module such as a parallel resonant circuit adjusted to resonate with the frequency of a high-frequency signal used for communication. The parallel resonant module is placed on the connection line between the communication module and the central conductor of the antenna connector so as to secure electric conduction between one end of the central conductor and the ground to thereby keep the potential of the central conductor at certain potential.

When the parallel resonant module is provided, the same effect as that in the case where a short stub module is used can be obtained without any influence on the dimensions of the wireless explosion-proof apparatus even if the operating wireless frequency is reduced.

(Description of Configuration)

Figure 4:
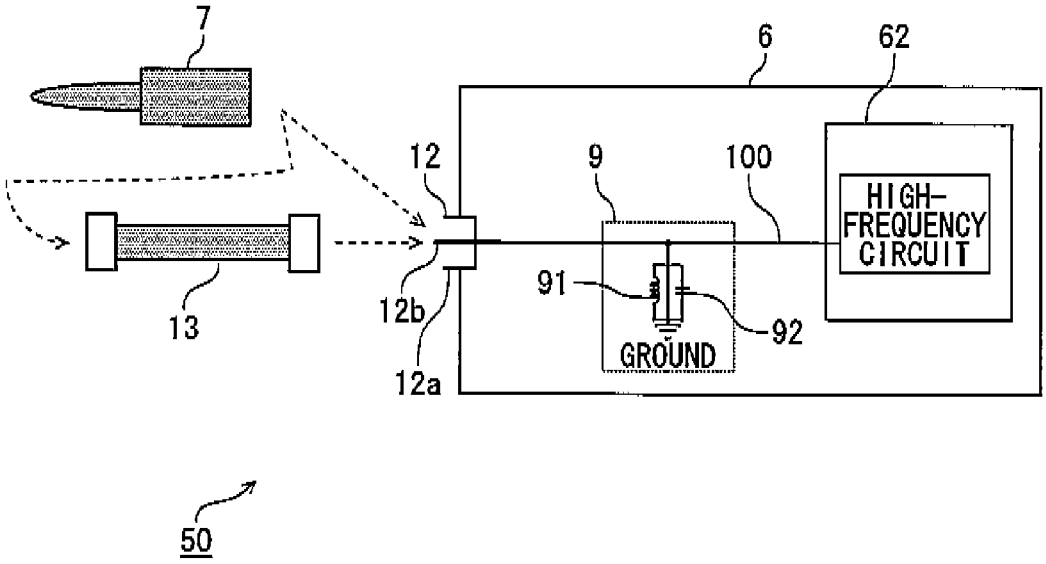
FIG. 4 is an explanatory configuration view showing another embodiment of a wireless explosion-proof apparatus according to the invention.

FIG. 4 is an explanatory configuration view showing another embodiment of a wireless explosion-proof apparatus according to the invention. Description on components in FIG. 4 in common with those in FIG. 1 will be omitted appropriately.

In FIG. 4, the central conductor 12*b* of the antenna connector 12 is extended from the sectionally central portion of the shell 12*a* and the other end of the central conductor 12*b* is exposed to the outside of the explosion-proof chamber 6.

The one end of the central conductor 12*b* of the antenna connector 12 is electrically connected to the communication module 62 through the connection line 100.

A parallel resonant module 9 is constituted by a coil 91 and a capacitor 92, and disposed in the explosion-proof chamber 6 and on the connection line 100 through which one end of the central conductor 12*b* of the antenna connector 12 is electrically connected to the communication module 62.

The parallel resonant module 9 branches a current flowing from the central conductor 12*b* and secures electric conduction between the one end of the central conductor 12*b* and the ground through the coil 91. Thus, the potential of the central conductor 12*b* can be kept at certain potential.

Based on the relationship between the resistance of the coil 91 and the capacitance value of the capacitor 92, the parallel resonant module 9 is adjusted to resonate with the frequency of a high-frequency signal used for communication by the wireless explosion-proof apparatus according to the invention. Here, during parallel resonation, the impedance of the parallel resonant module 9 reaches the maximum while the current flowing through the parallel resonant module 9 reaches the minimum.

(Operation and Effects)

With this configuration, the wireless explosion-proof apparatus according to the invention performs the following operation to fulfill the following effects.

For example, the communication module 62 outputs a high-frequency signal generated by the high-frequency circuit. The high-frequency signal is inputted into the antenna connector 12 through the parallel resonant module 9.

When the antenna 7 is connected directly to the antenna connector 12, the high-frequency signal is supplied to the antenna 7 through the antenna connector 12, released to the space and transmitted to an external field device or the like.

When the antenna 7 is connected to the antenna connector 12 through the high-frequency cable 13, the high-frequency signal is supplied from the antenna connector 12 to the antenna 7 through the high-frequency cable 13, released to the space and transmitted to the external field device or the like.

When the high-frequency signal is inputted/outputted between the communication module 62 and the antenna 7, the signal path is connected (AC-grounded) to the ground through the parallel resonant module 9. However, an extremely small part of the high-frequency signal is branched into the ground because the parallel resonant module 9 has very high impedance in the frequency of the high-frequency signal. On the other hand, the DC resistance of the coil 91 is extremely small.

In addition, when the central conductor 12*b* of the antenna connector 12 is observed from the outside of the wireless explosion-proof apparatus, the conductor is connected (AC-grounded) to the ground through the coil 91. Thus, the potential of the conductor is normally zero.

Accordingly, in the wireless explosion-proof apparatus according to the invention, the parallel resonant module resonating based on a frequency of the wireless signal is disposed in the explosion-proof chamber and on the connection line, through which one end of the central conductor of the connector portion for the antenna is connected to the communication module, and the parallel resonant module secures electric conduction between the one end of the central conductor and the ground so as to keep potential of the central conductor at certain potential, while the other end of the central conductor of the connector portion for the antenna is exposed to the outside of the explosion-proof chamber. Thus, explosion-proof specification (Type-n explosion-proof specification) can be satisfied properly without using any pressure-tight chamber, and high-performance wireless communication can be performed. When the parallel resonant module is provided, the same effect as that in the case where a short stub module is used can be obtained without any influence on the dimensions of the wireless explosion-proof apparatus even if the operating wireless frequency is reduced.

In the wireless explosion-proof apparatus according to this embodiment, the communication module may be connected to one end of the central conductor of the antenna connector through blocking capacitors as shown in the aforementioned second embodiment.

In this case, the one end of the central conductor 12*b* of the antenna connector 12 is electrically connected to the communication module 62 through the connection line 100, the first blocking capacitor module 81 and the second blocking capacitor module 82.

The parallel resonant module 9 is disposed in the explosion-proof chamber 6 and on the connection line 100 through which one end of the central conductor 12*b* of the antenna connector 12 is electrically connected to the first blocking capacitor module 81. The parallel resonant module 9 branches a current flowing from the central conductor 12*b* and secures electric conduction between the one end of the central conductor 12*b* and the ground through the coil 91. Thus, the potential of the central conductor 12*b* can be kept at certain potential. As a result, DC potential can be prevented from being generated in the central conductor 12*b* even if the communication module 62 is out of order.

Thus, the intrinsically safe explosion-proof specifications can be satisfied even if the central conductor 12*b* of the antenna connector 12 is exposed to the outside of the explosion-proof chamber 6.

Accordingly, in the wireless explosion-proof apparatus of the invention, the blocking capacitor module for blocking a DC current from the communication module is provided in the explosion-proof chamber and on the connection line through which one end of the central conductor of the connector portion is connected to the communication module. Thus, an intrinsically safe explosion-proof structure is formed properly without using any pressure-tight chamber, so that high-performance wireless communication can be performed.

Fourth Embodiment

Figure 5A:
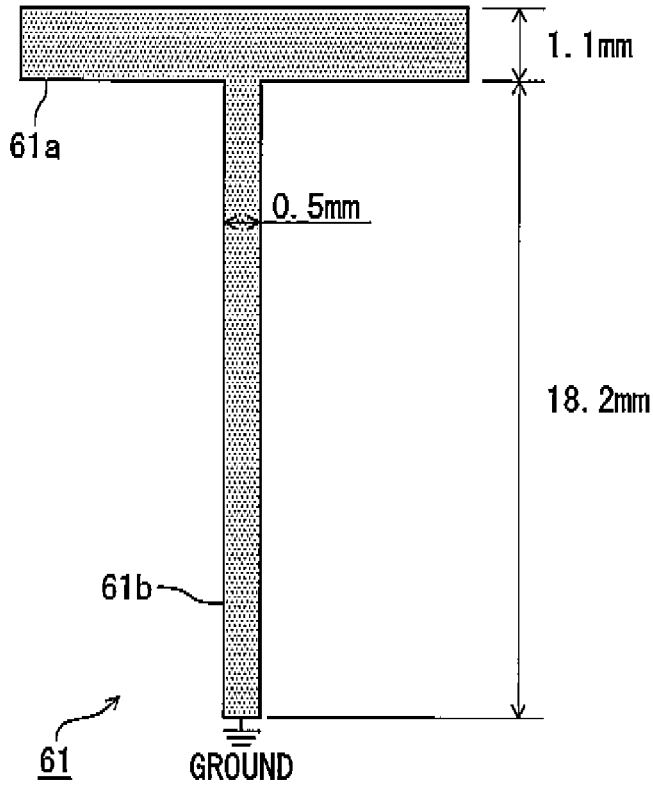
FIG. 5A is an explanatory configuration view showing an example of the configuration of a short stub module in the wireless explosion-proof apparatus according to the invention.
Figure 5B:
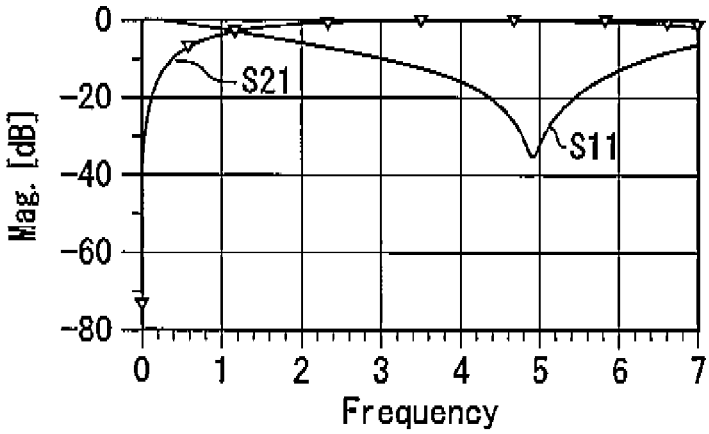
FIG. 5B is a graph for explaining the frequency characteristic obtained by the short stub module of FIG. 5A.

The short stub module 61 in the wireless explosion-proof apparatus according to the aforementioned first or second embodiment may have a configuration shown in FIG. 5A. FIG. 5A is an explanatory configuration view showing an example of the configuration of a short stub module in the wireless explosion-proof apparatus according to the invention. FIG. 5B is a graph for explaining the frequency characteristic obtained by the short stub module. Description on components in FIG. 5A in common with those in FIG. 1 will be omitted appropriately.

In FIG. 5A, the short stub module 61 is constituted by a first connection line 61*a* and a second connection line 61*b* in the explosion-proof chamber 6. The first connection line 61*a* electrically connects one end of the central conductor 12*b* of the antenna connector 12 with the communication module 62 (or the first blocking capacitor module 81) (the first connection line 61*a* may be disposed on the connection line 100). The second connection line 61*b* branches a current flowing from the central conductor 12*b* from the first connection line 61*a*, so as to secure electric conduction between the one end of the central conductor 12*b* and the ground.

In the short stub module 61, the current flowing from the central conductor 12*b* of the antenna connector 12 is branched from the first connection line 61*a* electrically connecting the one end of the central conductor 12*b* with the communication module 62, so as to secure electric conduction between the one end of the central conductor 12*b* and the ground through the second connection line 61*b*. Thus, the potential of the central conductor 12*b* can be kept at certain potential.

In addition, in the wireless explosion-proof apparatus according to this embodiment, a high-frequency signal inputted from one end of the first connection line 61*a* is band-limited into a signal component having the length of the second connection line 61*b* as $\lambda/4$ by the short stub module 61 so that the band-limited signal component is outputted to the other end of the first connection line 61*a*.

The case where the first connection line 61*a* is 1.1 mm wide, and the second connection line 61*b* is 0.5 mm wide and 18.2 mm long is shown as a specific design example in FIG. 5A. FIG. 5B is a graph for explaining the frequency characteristic obtained by the short stub module in this embodiment.

Accordingly, in the wireless explosion-proof apparatus according to the invention, the short stub module is disposed in the explosion-proof chamber and on the connection line, through which one end of the central conductor of the connector portion for the antenna is connected to the communication module, and the short stub module secures electric conduction between the one end of the central conductor and the ground so as to keep potential of the central conductor at certain potential, while the other end of the central conductor of the connector portion for the antenna is exposed to the outside of the explosion-proof chamber. Thus, explosion-proof specification (Type-n explosion-proof specification) can be satisfied properly without using any pressure-tight chamber, and high-performance wireless communication can be performed.

Fifth Embodiment

Figure 6:
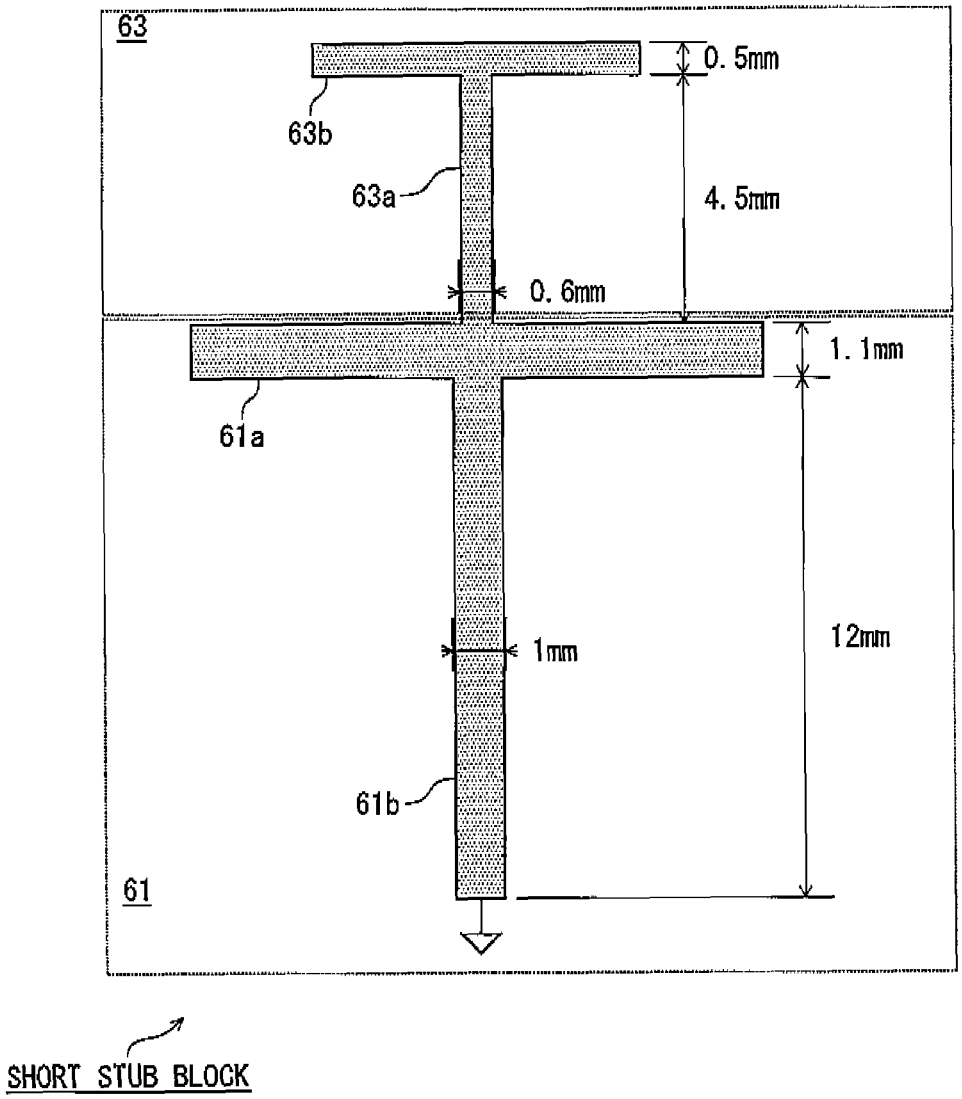
FIG. 6 is an explanatory configuration view showing another example of the configuration of a short stub module in the wireless explosion-proof apparatus according to the invention.

The short stub block of the wireless explosion-proof apparatus according to the aforementioned first or second embodiment may consist of a short stub module with a filter function for eliminating a certain signal component due to an open stub mounted therein. FIG. 6 is an explanatory configuration view showing another example of the configuration of a short stub module in the wireless explosion-proof apparatus according to the invention. Description on components in FIG. 6 in common with those in FIGS. 1 and 5A will be omitted appropriately.

In FIG. 6, the short stub block of the wireless explosion-proof apparatus according to this embodiment is constituted by a short stub module 61 and an open stub module 63.

The short stub module 61 is constituted by a first connection line 61*a* and a second connection line 61*b* in the explosion-proof chamber 6. The first connection line 61*a* electrically connects one end of the central conductor 12*b* of the antenna connector 12 with the communication module 62 (or the first blocking capacitor module 81) (the first connection line 61*a* may be disposed on the connection line 100). The second connection line 61*b* branches a current flowing from the central conductor 12*b* from the first connection line 61*a*, so as to secure electric conduction between the one end of the central conductor 12*b* and the ground.

The open stub module 63 is constituted by a third connection line 63*a* and a fourth connection line 63*b* in the explosion-proof chamber 6. The third connection line 63*a* is branched from the first connection line 61*a*. The fourth connection line 63*b* is electrically connected to the third connection line 63*a*.

In the short stub module 61, the current flowing from the central conductor 12*b* of the antenna connector 12 is branched from the first connection line 61*a* electrically connecting the one end of the central conductor 12*b* with the communication module 62, so as to secure electric conduction between the one end of the central conductor 12*b* and the ground through the second connection line 61*b*. Thus, the potential of the central conductor 12*b* can be kept at certain potential.

On this occasion, the current flowing from the central conductor 12*b* is branched by the first connection line 61*a* of the short stub module 61 so as to flow into the third connection line 63*a* and the fourth connection line 63*b* of the open stub module 63.

The case where the first connection line 61*a* is 1.1 mm wide, the second connection line 61*b* is 1 mm wide and 12 mm long, the third connection line 63*a* is 0.6 mm wide and 4.5 mm long, and the fourth connection line 63*b* is 0.5 mm wide and 12 mm long is shown as a specific design example in FIG. 6.

With this configuration, in the wireless explosion-proof apparatus according to this embodiment, a high-frequency signal inputted from one end of the first connection line 61*a* is band-limited into a signal component having the length of the second connection line 61*b* as $\lambda/4$ by the short stub module 61 so that the band-limited signal component is outputted to the other end of the first connection line 61*a*. In addition to this operation, in the wireless explosion-proof apparatus according to this embodiment, the high-frequency signal inputted from the one end of the first connection line 61*a* is branched and supplied to the third connection line 63*a* of the open stub module 63 so that a certain signal component of the signal transmitted/received by the communication module 62 can be eliminated. In other words, the effect of a notch filter can be obtained by this configuration.

Figure 7:
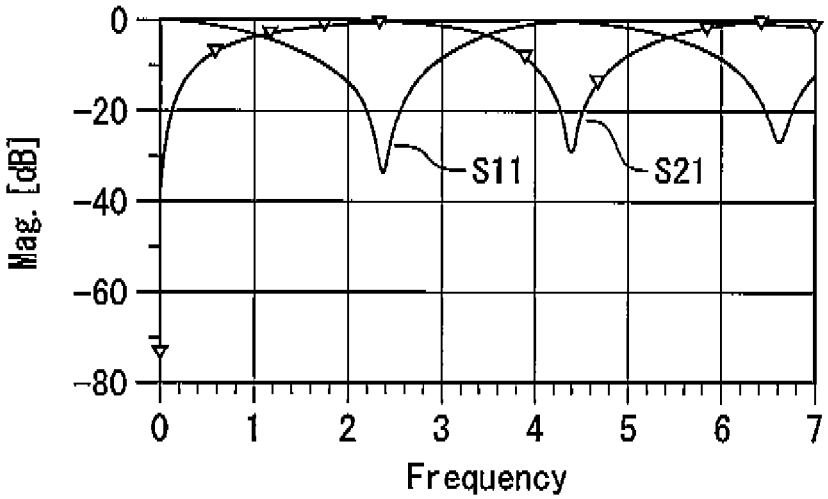
FIG. 7 is a graph for explaining the frequency characteristic obtained by the short stub module of FIG. 6.

As a result, the short stub module 61 of the wireless explosion-proof apparatus according to the invention can obtain a certain frequency characteristic. FIG. 7 is a graph for explaining the frequency characteristic obtained by the short stub module of FIG. 6. For example, good band rejection as seen at 2.4 GHz in S11 and 4.4 GHz in S21 can be obtained as shown in FIG. 7.

Accordingly, in the wireless explosion-proof apparatus according to the invention, the short stub module is disposed in the explosion-proof chamber and on the connection line, through which one end of the central conductor of the connector portion for the antenna is connected to the communication module, and the short stub module secures electric conduction between the one end of the central conductor and the ground so as to keep potential of the central conductor at certain potential, while the other end of the central conductor of the connector portion for the antenna is exposed to the outside of the explosion-proof chamber. Thus, explosion-proof specification (Type-n explosion-proof specification) can be satisfied properly without using any pressure-tight chamber, and high-performance wireless communication can be performed. Further, when a short stub module for obtaining the effect of a notch filter is used, high-performance wireless communication with certain frequency characteristics can be attained.

Sixth Embodiment

Figure 8A:
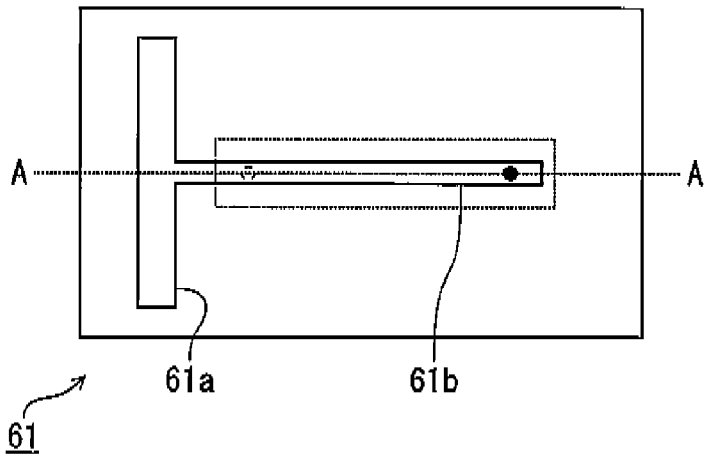
FIGS. 8A and 8B are explanatory configuration views showing another example of the configuration of a short stub module in the wireless explosion-proof apparatus according to the invention.
Figure 8B:
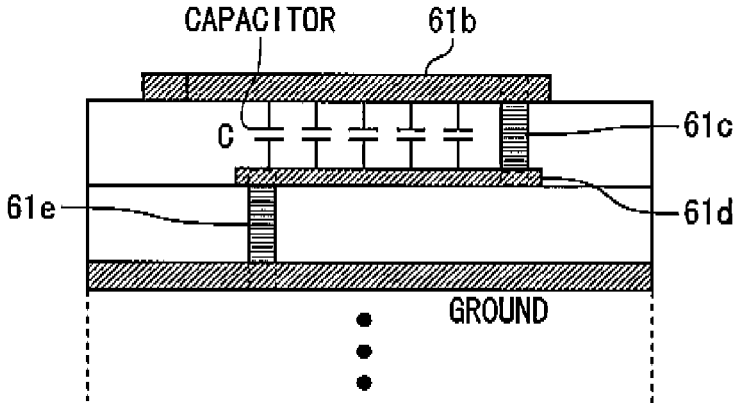

The short stub module 61 in the wireless explosion-proof apparatus according to the aforementioned first or second embodiment may be constituted by a circuit consisting of distributed constants (distributed constant circuit). FIGS. 8A and 8B are explanatory configuration views showing another example of the configuration of a short stub module in the wireless explosion-proof apparatus according to the invention, FIG. 5A is a top view, and FIG. 8B is a sectional view taken on line A-A. Description on components in FIGS. 5A and 5B in common with those in FIGS. 1 and 5A will be omitted appropriately.

In FIGS. 5A and 8B, the short stub module 61 is constituted by a first connection line 61*a* (inductor line) and a second connection line 61*b* in the explosion-proof chamber 6. The first connection line 61*a* electrically connects one end of the central conductor 12*b* of the antenna connector 12 with the communication module 62 (or the first blocking capacitor module 81) (the first connection line 61*a* may be disposed on the connection line 100). The second connection line 61*b* is branched from the first connection line 61*a*, so as to secure electric conduction with the ground.

In addition, the short stub module 61 according to this embodiment consists of two layers (two boards). The second connection line 61*b* (inductor line) formed in the first layer (surface layer) is electrically connected to an inner layer line 61*d* formed in the second layer (inner layer) through a through hole 61*c* formed in the first layer.

The inner layer line 61*d* is electrically connected to the ground (grounded to the casing) through a through hole 61*e* formed in the second layer.

In addition, the short stub module 61 according to the embodiment also consists of a plurality of capacitors electrically connected to the second connection line 61*b* and the inner layer line 61*d* respectively.

That is, in the short stub module 61 of the wireless explosion-proof apparatus according to this embodiment, the second connection line 61*b* (inductor line) is capacitively interlayer-coupled with the inner layer line 61*d*.

Figure 9:
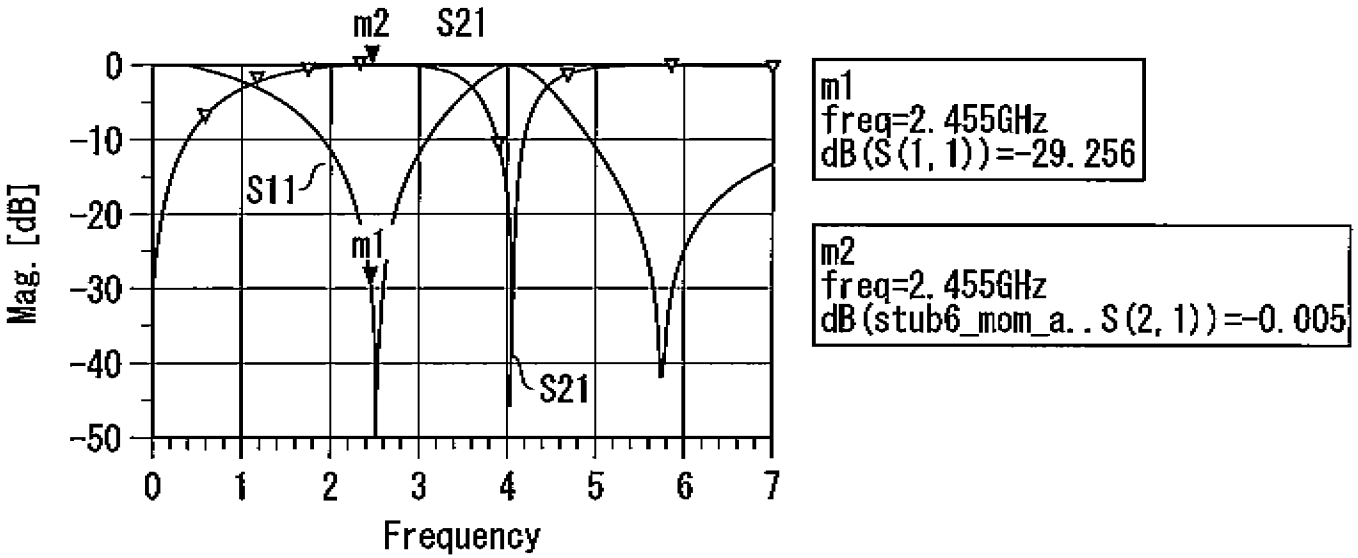
FIG. 9 is a graph for explaining the frequency characteristic obtained by the short stub module of FIG. 8.

With this configuration using interlayer coupling, the short stub module 61 of the wireless explosion-proof apparatus according to this embodiment can obtain a certain frequency characteristic. FIG. 9 is a graph for explaining the frequency characteristic obtained by the short stub module of FIGS. 5A and 8B. For example, high precision matching as seen at 2.5 GHz or good band rejection as seen at 4 GHz in S21 can be obtained as shown in FIG. 9.

Accordingly, in the wireless explosion-proof apparatus of the invention, the short stub module is disposed in the explosion-proof chamber and on the connection line, through which one end of the central conductor of the connector portion for the antenna is connected to the communication module, and the short stub module secures electric conduction between the one end of the central conductor and the ground so as to keep potential of the central conductor at certain potential, while the other end of the central conductor of the connector portion for the antenna is exposed to the outside of the explosion-proof chamber. Thus, explosion-proof specification (Type-n explosion-proof specification) can be satisfied properly without using any pressure-tight chamber, and high-performance wireless communication can be performed. Further, when a short stub module using interlayer coupling is used, high-performance wireless communication with certain frequency characteristics can be performed.

The short stub module in this embodiment obtains an intended frequency characteristic due to the structure of two layers coupled capacitively. However, the short stub module is not limited to this especially, but may be arranged by electromagnetic coupling or any configuration about the number of layers, the coupling capacitance, the coupling factor, etc. may be used if the intended frequency characteristic can be obtained.

Seventh Embodiment

The short stub module may be arranged to correspond to a plurality of bands. FIG. 10A is an explanatory configuration view showing another example of the configuration of a short stub module arranged to correspond to two bands, that is, a 2.4 GHz band and a 5 GHz band. Description on components in FIG. 10A in common with those in FIGS. 1, 5A, 6, 8A and 5B will be omitted appropriately.

In FIG. 10A, the pattern of the first connection line 61*a* is shaped to set the characteristic impedance at 50Ω. A high-frequency signal is inputted from one end of the first connection line 61*a* and outputted from the other end of the first connection line 61*a* in a horizontal direction.

One end of the second connection line 61*b* is connected to a central portion of a lower side of the first connection line 61*a* at right angles, while the other end of the second connection line 61*b* is DC-connected to the ground through three crank-like patterns CP1 to CP3 connected in series.

The case where the first connection line 61*a* is 1.1 mm wide, the second connection line 61*b* is fundamentally 0.5 min wide, and each of the first crank-like pattern CP1 and the second crank-like pattern CP2 is 1.5 mm wide in its side parallel to the first connection line 61*a* is shown as a specific design example in FIG. 10A.

When the second connection line 61*b* is observed from the first connection line 61*a* in this configuration, the second connection line 61*b* serves as a high impedance line for high-frequency signals of the 2.4 GHz band and the 5 GHz band supplied from the one end of the first connection line 61*a*, so that those high-frequency signals can be transmitted to the other end of the first connection line 61*a* with low loss and without leaking to the second connection line 61*b*.

Figure 10B:
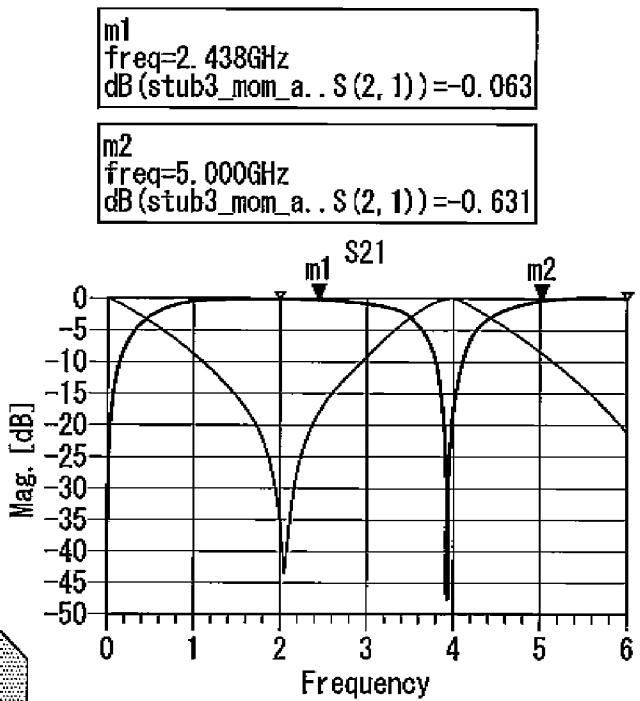
FIG. 10B is a graph for explaining the frequency characteristic obtained by the short stub module of FIG. 10A.
Figure 10A:
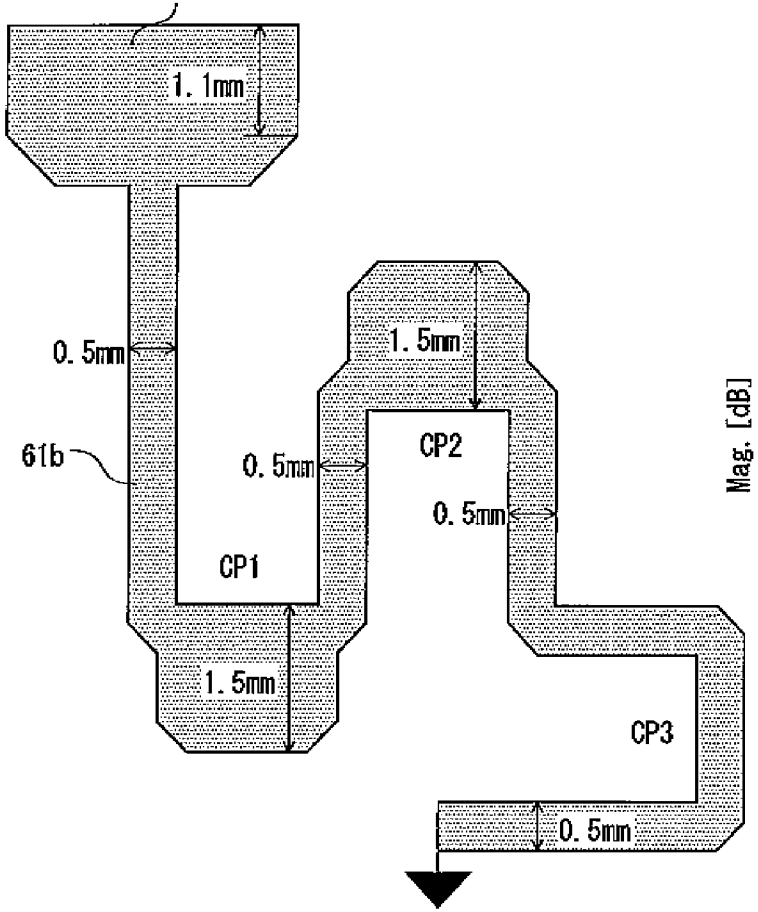
FIG. 10A is explanatory configuration view showing another example of the configuration of a short stub module in the wireless explosion-proof apparatus according to the invention.

FIG. 10B is a graph for explaining the frequency characteristic obtained by the short stub module in FIG. 10A. From the characteristic curve of S21, it can be proved that in-band losses at 2.4 GHz and 5 GHz are low.

The configuration example arranged to correspond to the two bands, that is, the 2.4 GHz band and the 5 GHz band, has been described in the example of FIGS. 10A and 10B. However, the number of bands is not limited to two. As to the number of elements in the short stub module, a plurality of elements may be provided in one and the same circuit. In addition, the number of crank-like patterns is not limited to three, but may be increased or decreased in accordance with the design.

Eighth Embodiment

In addition, the short stub module may be arranged as a voltage-controlled-variably-type short stub whose characteristic can be adjusted to a desired frequency band. FIG. 11A is an explanatory configuration view of a voltage-controlled-variably-type short stub arranged to correspond to two bands, that is, a 2.4 GHz band and a 5 GHz band. Description on components in FIG. 11A in common with those in FIGS. 1, 5A, 6, 8A, 8B and 10A will be omitted appropriately.

In FIG. 11A, the pattern of the first connection line 61*a* is shaped to set the characteristic impedance at 50Ω. A high-frequency signal is inputted from one end of the first connection line 61*a* and outputted from the other end of the first connection line 61*a* in the horizontal direction.

One end of the second connection line 61*b* is connected to the central portion of the lower side of the first connection line 61*a* at right angles, while the other end of the second connection line 61*b* is DC-connected to the ground through a crank-like pattern CP1.

A third connection line 61*g* is formed as a straight-line pattern serving as an open stub. One end of the third connection line 61*g* is disposed oppositely to a central portion of an upper side of the first connection line 61*a* at right angles and with interposition of a variable capacitance element 61*f*. The variable capacitance element 61*f* is an element whose capacitance value can be changed in accordance with changes of voltages applied to the second connection line 61*b* and the variable capacitance element 61*f*. For example, a varactor diode, a variable capacitance diode, a metamaterial element, or the like is used.

The case where the second connection line 61*b* and the third connection line 61*g* are 1.1 mm wide and the first connection line 61*a* is a little wider than 1.1 mm is shown as a specific design example in FIG. 11A.

In this configuration, high-frequency signals of the 2.4 GHz band and the 5 GHz band inputted from the one end of the first connection line 61*a* are branched into a system of the second connection line 61*b* with high impedance in view from the first connection line 61*a* and a system of a series circuit of the variable capacitance element 61*f* and the third connection line 61*g*. The capacitance value of the variable capacitance element 61*f* can be changed in accordance with a change of the voltage applied thereto. After the high-frequency signals are subjected to influence from both the systems, the high-frequency signals are outputted from the other end of the first connection line 61*a*.

Here, the frequency characteristic of each signal outputted from the other end of the first connection line 61*a* can be changed and adjusted desirably in accordance with a change of the voltage applied to the variable capacitance element 61*f*.

Figure 11B:
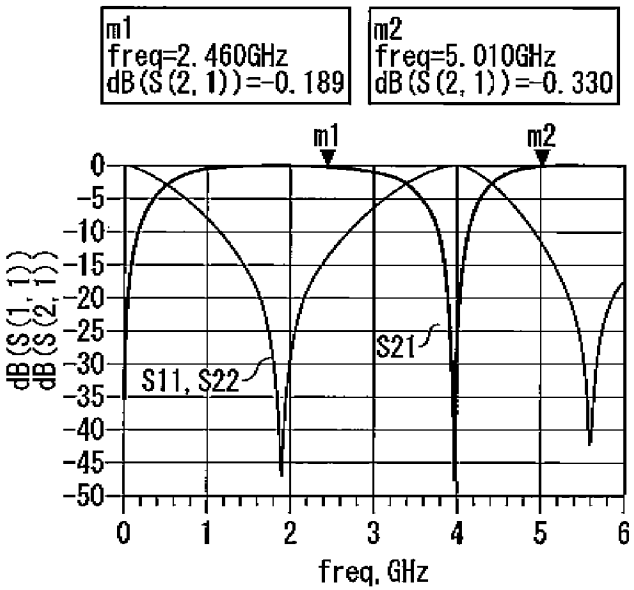
FIG. 11B is a graph for explaining the frequency characteristic obtained by the short stub module of FIG. 11A.
Figure 11A:
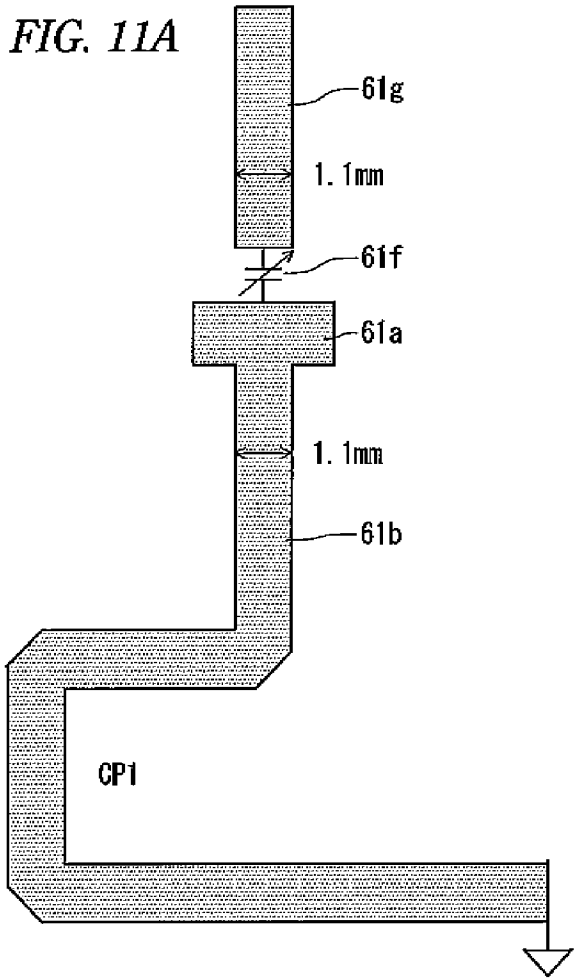
FIG. 11A is explanatory configuration view showing another example of the configuration of a short stub module in the wireless explosion-proof apparatus according to the invention.

FIG. 11B is a graph for explaining the frequency characteristic obtained by the short stub module in FIG. 11A. FIG. 11B shows a characteristic example in the case where the capacitance value of the variable capacitance element 61*f* corresponds to 1 pF. From the characteristic curve of S21, it can be proved that in-band losses at 2.4 GHz and 5 GHz are low.

The configuration example arranged to correspond to the two bands, that is, the 2.4 GHz band and the 5 GHz band, has been described in the example of FIGS. 11A and 11B. However, the number of bands is not limited to two. As to the number of elements in the short stub module, a plurality of elements may be provided in one and the same circuit. In addition, the number of variable capacitance elements 61*f* is not limited to one, but two or more variable capacitance elements 61*f* may be provided.

Ninth Embodiment

Figure 12:
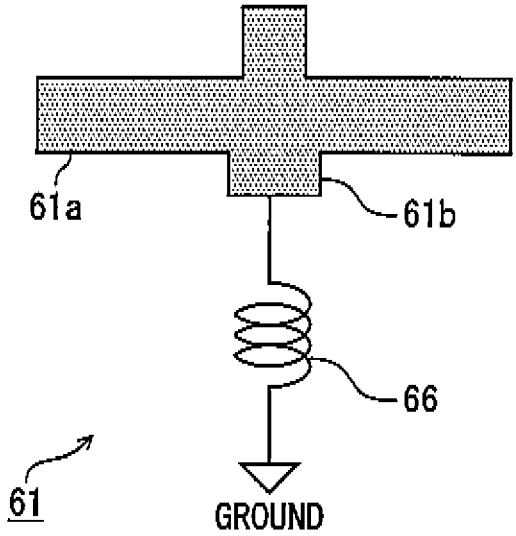
FIG. 12 is an explanatory configuration view showing another example of the configuration of a short stub module in the wireless explosion-proof apparatus according to the invention.

The short stub module 61 in the wireless explosion-proof apparatus according to the aforementioned first or second embodiment may be constituted by a circuit consisting of lumped constants (lumped constant circuit). FIG. 12 is an explanatory configuration view showing another example of the configuration of a short stub module in the wireless explosion-proof apparatus according to the invention. Description on components in FIG. 12 in common with those in FIGS. 1 and 5A will be omitted appropriately.

In FIG. 12, a high-frequency signal inputted from one end of the central conductor 12*b* of the antenna connector 12 to one end of the first connection line 61*a* is matched and band-limited with a desired frequency by a surface mount device, a DIP inductor 66 or the like provided on the first connection line 61*a*. The band-limited high-frequency signal is outputted to the other end of the first connection line 61*a*. In addition, the DC potential of a signal line designated by the first connection line 61*a* is connected to the ground through the inductor.

Figure 13:
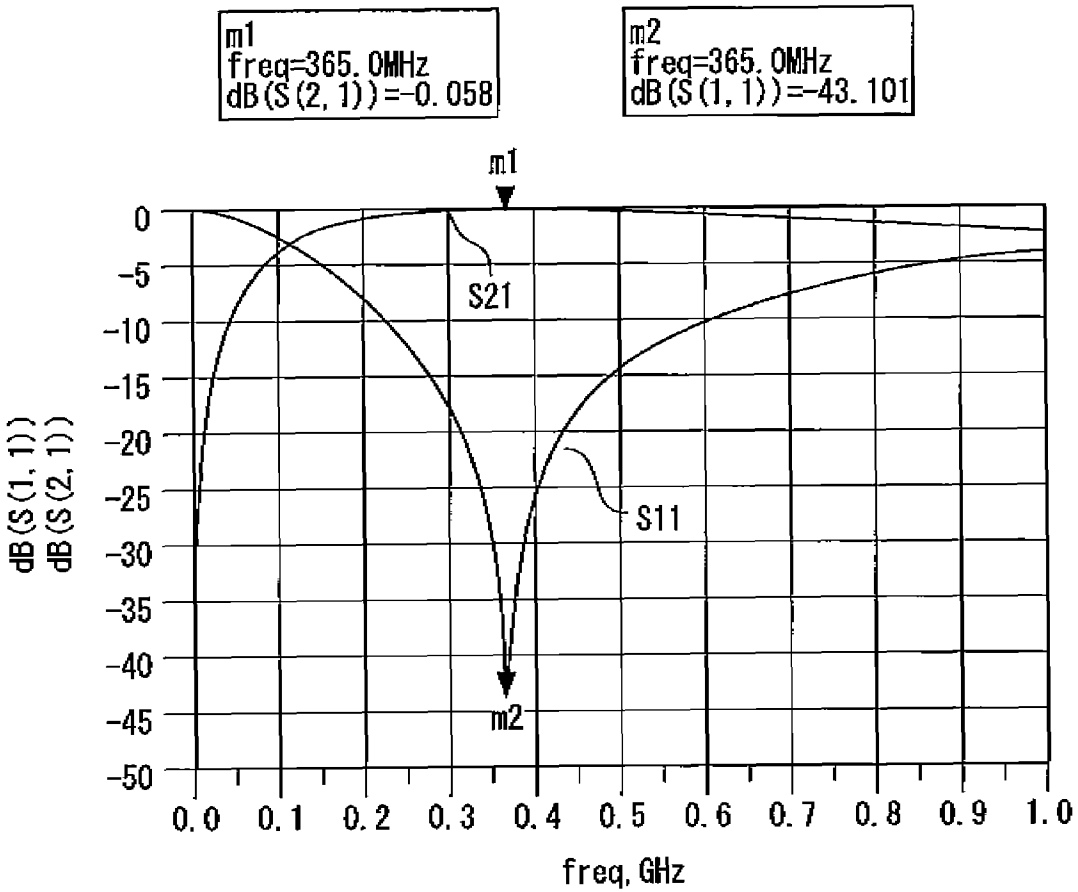
FIG. 13 is a graph for explaining the frequency characteristic obtained by the short stub module of FIG. 12.

With this configuration, the short stub module 61 of the wireless explosion-proof apparatus according to this embodiment can obtain a certain frequency characteristic. FIG. 13 is a graph for explaining the frequency characteristic obtained by the short stub module of FIG. 12. For example, good band rejection as seen at 0.36 GHz in S11 can be obtained as shown in FIG. 13.

Accordingly, in the wireless explosion-proof apparatus of the invention, the short stub module is disposed in the explosion-proof chamber and on the connection line, through which one end of the central conductor of the connector portion for the antenna is connected to the communication module, and the short stub module secures electric conduction between the one end of the central conductor and the ground so as to keep potential of the central conductor at certain potential, while the other end of the central conductor of the connector portion for the antenna is exposed to the outside of the explosion-proof chamber. Thus, explosion-proof specification (Type-n explosion-proof specification) can be satisfied properly without using any pressure-tight chamber, and high-performance wireless communication can be performed. Further, when the short stub module using a lumped constant circuit is used, the space can be saved.

While certain embodiments have been described, these embodiments have been presented by way of example only, and are not intended to limit the scope of the invention. Indeed, the novel apparatus described herein may be embodied in a variety of other forms; furthermore, various omissions, substitutions and changes in the form of the apparatus, described herein may be made without departing from the sprit of the invention. The accompanying claims and their equivalents are intended to cover such forms or modifications as would fall within the scope and sprit of the invention.

What is claimed is:

1. A wireless explosion-proof apparatus in which a communication module configured to transmit and receive a wireless signal through an antenna is disposed inside an explosion-proof chamber, comprising:

a connection line disposed in the explosion-proof chamber, the connection line configured to connect one end of a central conductor of a connector portion of the antenna to the communication module; and a short stub module disposed in the explosion-proof chamber and disposed on the connection line, the short stub module configured to secure electric conduction between the one end of the central conductor and a ground so as to keep potential of the central conductor at certain potential, wherein an other end of the central conductor of the connector portion of the antenna is exposed to the outside of the explosion-proof chamber, the short stub module is configured to short circuit the one end of the central conductor and the ground in terms of DC, and the other end of the central conductor of the connector portion of the antenna is a bare live part connectable to ground, wherein the short stub module includes a distributed constant circuit, and wherein the short stub module is formed to correspond to a plurality of bands, the short stub having a first connection line pattern in which a high-frequency signal is inputted from one end and outputted from the other end in a horizontal direction, and a second connection line pattern one end of which is connected to a central portion of a lower side of the first connection line pattern at right angles and the other end of which is DC-connected to the ground through at least one of crank-like patterns connected in series.

2. The wireless explosion-proof apparatus according to claim 1, wherein the short stub module further has a third connection line pattern which is a straight-line pattern serving as an open stub, the third connection line having one end disposed oppositely to a central portion of an upper side of the first connection line pattern at right angles and with interposition of a variable capacitance element whose capacitance value can be varied in accordance with a voltage applied thereto.

3. The wireless explosion-proof apparatus according to claim 1, wherein the antenna is connected to the other end of the central conductor of the connector portion and disposed outside the explosion-proof chamber.

4. The wireless explosion-proof apparatus according to claim 1, further comprising:

a cable module configured to transmit the signal from the antenna, wherein the antenna is connected to the other end of the central conductor of the connector portion through the cable module.

5. The wireless explosion-proof apparatus according to claim 1, further comprising:

a blocking capacitor module disposed in the explosion-proof chamber and disposed on the connection line, the blocking capacitor module configured to block a DC current from the communication module.

6. The wireless explosion-proof apparatus according to claim 1, wherein the connector portion has a threaded outer circumferential portion that is exposed to the outside of the explosion-proof chamber.

7. The wireless explosion-proof apparatus according to claim 1, wherein the other end of the central conductor is solid.

* * * * *